United States Patent [19]

Rohowetz

[11] Patent Number: 4,495,156

[45] Date of Patent: Jan. 22, 1985

[54] PRIMARY SYSTEM

[75] Inventor: Stanley E. Rohowetz, Neenah, Wis.

[73] Assignee: American Can Company, Greenwich, Conn.

[21] Appl. No.: 455,649

[22] Filed: Jan. 5, 1983

[51] Int. Cl.[3] ..... B05D 1/36; B05D 7/00; B05D 3/02

[52] U.S. Cl. ..... 427/384; 106/287.19; 252/32; 260/429.5; 427/417; 427/419.8

[58] Field of Search ..... 148/6.14 R, 6.2; 427/388.2, 388.4, 399, 409, 407.1, 27, 384, 417, 419.8; 106/287.19; 260/429.5; 252/32

[56] References Cited

U.S. PATENT DOCUMENTS

| | | | |
|---|---|---|---|
| 3,776,848 | 12/1973 | Hall et al. | 148/6.14 R X |
| 4,110,129 | 8/1978 | Matsushima et al. | 148/6.15 R |
| 4,148,970 | 4/1979 | McIntosh et al. | 148/6.2 X |
| 4,228,221 | 10/1980 | Rohowetz | 427/27 X |
| 4,294,627 | 10/1981 | Heyes | 148/6.14 R |
| 4,370,177 | 1/1983 | Frelin et al. | 148/6.27 |

*Primary Examiner*—Michael R. Lusignan

*Attorney, Agent, or Firm*—Ernestine C. Bartlett; Paul R. Audet; Stuart S. Bowie

[57] ABSTRACT

A method is provided wherein an aqueous titanate chelate is applied "in-line" to non-lubricated or lubricated tinplate surfaces during metal forming operations. The method provides economical benefits in using a non-combustible solvent system and in requiring minimal energy output for application or activation of the chelate. Inks or coatings that are subsequently applied to the chelate treated surfaces show improved adhesion.

12 Claims, No Drawings

PRIMARY SYSTEM

BACKGROUND OF THE INVENTION

Steel that is to be fabricated into articles such as food cans, beer and beverage cans, etc. is normally subjected to a number of pretreatment steps prior to shipment to the producer of the article. In a typical pretreatment line, a continuous coil of steel is covered by a layer of electrolytically deposited tin which may have a small amount of tin oxide on its surface, over which is deposited a discontinuous layer of chromium and/or chromium oxide for example, by cathodic treatment in a sodium dichromate solution, after which it is subjected to a water rinse, after which a generally thin layer of lubricant is applied, after which it is dried and recoiled for shipment.

As a result of the tinplate and chromium treatment steps, the surface of the electrolytic tinplate has areas which are rich in tin and its oxides. Such material is prepared at the steel mill and can be ordered with varying weights of steel plate by the can makers convention of so many pounds of steel per base box which equals 31,360 square inches of plate with 62,720 square inches of surface (both sides). The amount of electrolytically deposited tin is designated by a fraction of a pound per base box (62,720 square inches).

Bare tinplate surfaces usually contain electrolytically deposited chromium or its oxides which passivates the tin surface to prevent tin oxide growth in warm humid environments. In the past such oiled metal surfaces were frequently flame or corona treated to reduce or oxidize these organics; however, these techniques are slow and energy intensive and require capital investment for expensive line equipment and space in the plant. The chromium, while serving the useful function of passivating the surface, is nevertheless a malefactor that interferes with adhesion of subsequently applied coatings and or inks.

In order to provide surface mobility to prevent abrasion during shipping or handling of the tinplated steel, the steel mills usually deposit electrostatically onto the tinplate surface a very thin coating of lubricant such as acetyl tributyl citrate, dioctyl sebacate or the like. Thus, the material as received has a lightly oiled metallic surface having areas of tin and its oxide and areas of chrome and its oxides. The commonly used lubricants are acetyl tributyl citrate, dioctyl sebacate or butyl stearate, all of which are relatively nonoxidizing liquids. When they are applied to the metals at a rate of 0.17–0.28 grams per 62,720 square inches of surface (per base box), a coating is formed slightly in excess of a monomolecular layer which acts to increase mobility and prevent abrasion during handling and shipment.

Electrolytic tinplate has been difficult to cover with adhesive resin systems. It has therefore been necessary to prime the surfaces of coil with a substance capable of adding reactive sites for anchoring to the base substrate and overcoating.

Organic titanates are known to be useful for promotion of adhesion of inks and coatings to metal surfaces and have been used as primers and/or to modify inks and coatings for improved adhesion to the metal substrate.

Application of a titanate ester primer to cover the lubricants, contaminants, chromium and its oxides followed by subsequent treatment to activate the titanate, such as treatment with ultraviolet light, transforms the surface permitting subsequent application of ultraviolet or thermally cured inks or coatings. The bare surface of tinplate including the areas rich in chromium oxides and others of pure tin oxides become coated with an attached layer of hydrated titanium dioxide gel and thereby provides a satisfactory adhesive base for subsequent inks or coatings.

In my U.S. Pat. No. 4,228,221 dated Oct. 14, 1980, entitled "Primer System", there is disclosed a system wherein a titanate ester and ultraviolet treatment are employed to condition the surface of an organic lubricant over electrolytic tinplate such that subsequently applied ultraviolet activated inks could be firmly adhered. According to this procedure, organic titanates on metal surfaces are subjected to ultraviolet treatment to increase adhesion of inks and coatings. The method includes an initial treatment of lubricated metal with an organic titanate such as tetrakis-(2-ethyl hexyl) titanate and then exposing the treated metal to ultraviolet light to accelerate the reaction of the titanate with the metal surface. In this procedure, titanate esters or chelates are applied to metal surfaces including lubricated surfaces, such as electrolytic timplate, tin free steel, tin, stainless steel, chrome plated steel, galvanized steel and aluminum, by application from solvent mixtures or by direct contact after which the metal surface is subjected to ultraviolet light activation for oxidative polymerization of nondrying oils and for accelerated hydrolysis of titanate esters. Activation by ultraviolet radiation of organic titanate over lubricated metallic surfaces prior to printing or coating was found to prepare such surfaces for reception of a subsequently applied ink or coating. The application of ultraviolet energy subsequent to priming with an organic titanate was found to improve the bonding of the titanate to the substrate and the bonding of inks and coatings subsequently applied thereover.

While the process and primer of the aforesaid patent are highly satisfactory, they largely contemplate the use of solvent-based titanates, rely on ultraviolet light for activation and may lead to contamination of oiling or lubricating equipment with titanate.

The present invention is an improvement of the invention described and claimed in said patent in which environmentally detrimental organic solvents are eliminated and contamination of equipment with titanate is minimized. While ultraviolet light may be employed herein, if desired, it is not essential for activation of the system employed thereby rendering the system more versatile.

SUMMARY OF THE INVENTION

It has now been discovered that aqueous titanate chelate primers may be applied to metal substrates "in line", either prior to or subsequent to application of the lubricant, to provide improved adhesion to subsequently applied coatings or inks without the need for exposure to ultraviolet light to activate the reaction of the titanate with the metal surface. The invention thus relates to an applied primer covering a substrate selected from the group of 1) lightly lubricated metal substrates including various metals and their oxides to form a surface for receiving a subsequently applied coating; and 2) metal substrates including various metals and their oxides to form a substrate for receiving a subsequently applied lubricant and a subsequently applied coating, the primer consisting essentially of a thin film of organic titanate formed from an aqueous system comprising an organic titanate chelate.

The invention further relates to a method of priming metal substrates either prior to or subsequent to application of a lubricant to prepare it to receive a post coating including the steps of (a) coating the surface of metal substrate with an aqueous system comprising an organic titanate chelate;

(b) drying the coating to produce a film over the surface; and (c) applying a lubricant reactive with said titanate film to activate said titanate surface coating.

DETAILED DESCRIPTION OF THE INVENTION

In accordance with the invention, water-soluble or water-miscible organic titanates may be selected from such compounds having the general formula:

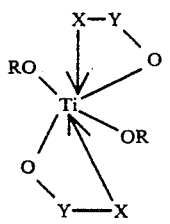

[A]

wherein X represents a functional group containing oxygen or nitrogen including such radicals as phosphato, phosphito, pyrophosphato, acetonyl; and Y is a hydrocarbon radical or hydrogen. Examples of preferred materials are those having the general formulae:

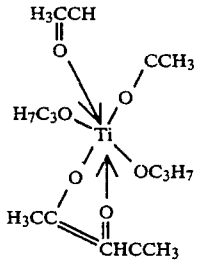

(1)

titanium acetyl acetonate

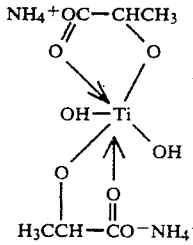

(2)

lactic acid titanium chelate

-continued

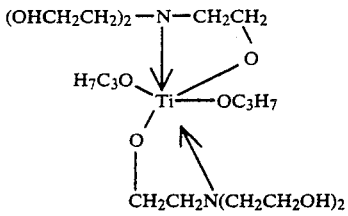

(3)

triethanolamine titanium chelate

Additional suitable compounds include any titanium chelates set forth above in the general formula [A] that are functional in aqueous systems either because of water solubility or water miscibility or because of solubility in a water-solvent mixture. Such compounds include titanium di(dioctylpyrosphosphate) oxyacetate; di(dioctylpyrophosphate) isopropyl titanate; di(acetylacetonyl) isopropyl titanate; di(ammonium lactate) titanate; di(triethanolamine) isopropyl titanate, etc.

Preferred compounds are the titanate acetylacetonate, ammonium lactate and triethanolamine chelates commercially available as TYZOR AA, TYZOR LA and TYZOR TE, respectively from E. I. DuPont De Nemours and Company. Additionally, chelates 138J, 138D or 238T, commercially available from Kenrich Petrochemicals may also be employed.

TYZOR AA is especially preferred. Preferably, the titanate chelates are employed as aqueous compositions comprising from about 0.1% to 5% titanate chelates and from about 0.5 to 3.0% of acetic acid or similar acid. The acetic acid functions to assist in the water solubilization of the chelate. Another acid that is effective at similar levels is citric acid.

The following examples will serve to illustrate the invention.

EXAMPLE 1

An aqueous system comprising water, 0.5% by weight Tyzor AA acetylacetonate titanium chelate and 1.0% acetic acid was sprayed onto tinplate coil stock, rinsed with water and dried with an air knife after which they were electrostatically lubricated with acetyl tributyl citrate. They were then coated with an ultraviolet light - curable ink, Red #2767, an acrylic ink available commercially from M & T Chemicals, and cured with exposure to ultraviolet radiation source sufficient to cure the ink.

The sample was then tested with a pressure sensitive adhesive tape. More particularly, a one inch strip of 3M tape #610 was applied to the surface of the decorated sample. The tape was pressed to the surface with sufficient pressure to make complete contact (removing the air bubbles therebetween). The tape test required that the tape be quickly pulled from the decorated sample in an effort to peel with it any poorly adhering ink or coating.

In order to further test peeling, X's are scribed on the surface to which the tape is to be applied. These X's present a freshly made scored edge which would help to initiate any peeling that might occur.

Considerable improvement over non-titanate treated surfaces was observed in the adhesive properties of the titanate-treated specimens.

EXAMPLE 2

Organic titanates such as Tyzor AA containing acetic acid in water, Tyzor LA and TE containing acetic acid in methyl cellosolve and water, and Kenrich's 138J, 138D or 238T containing acetic acid in isopropanol/water blends were fogged electrostatically onto the tinplate, with or without lubricant. For fogging, the metal is subjected to an oppositely charged titanate (and lubricant mixture, when present) which is atomized and dispersed towards the metal surface. Weights of titanate ester applications range from 0.25 gm to 2.5 gms per base box (62,720 square inches of surface). The treated combination provides a preserved and primed surface ready for coating, printing and subsequent forming.

Reactions of Titanates on Metal Or Polymer Surfaces

While the exact mechanism by which the titanate chelates function to improve adhesion is not precisely known, it is known that a chemical reaction takes place between the titanates and the metal.

It is believed that the titanate, the metal and any ambient water vapors or hydroxyl groups react to first form a dimer and then crosslink to form a trimer becoming an insoluble polymer gel.

During the reaction, alcohol is formed, released and evaporated. Evidence of alcohol can be smelled and verified by infrared analysis. What remains is a partly hydrolyzed insoluble titanate gel bonded to the metal.

Further reaction between the lubricant preservative (e.g. ATBC), the titanate and acetic acid may form tin acetates between the titanate gel and the lubricated preserved material. When the reaction takes place in an oxidizing atmosphere, an unsaturated intermediate is formed which reacts with either or both the partially hydrolyzed titanate ester and any freshly applied monomer to form a crosslinked polymer structure.

The titanium chelate is believed to be activated when the chelate structure hydrolyzes thereby activating the ligand.

While the invention has been illustrated with tinplate, it will be understood that it is equally effective when used on other metals such as tin free steel, tin, stainless steel, chrome plated steel, galvanized steel and aluminum.

What is claimed is:

1. A method for priming metal substrates including the steps of:
   (a) coating the surface of the metal substrate with an aqueous primer system comprising an organic titanium chelate dissolved in or admixed with water or a water-solvent mixture.
   (b) drying the coating to produce a titanate film on the metal surface; and
   (c) applying a lubricant over said titanate coated surface.

2. The method of claim 1 wherein said metal is tinplate.

3. The method of claim 2 wherein the primer is applied from an aqueous spray comprising a titanium chelate selected from the group consisting of titanium acetyl acetonate, lactic acid titanium chelate and triethanolamine titanium chelate.

4. The method of claim 3 wherein said lubricant is acetyl tributyl citrate or dioctyl sebacate.

5. A method for priming metal substrates including the steps of:
   (a) applying a coating of a lubricant onto the surface of the metal substrate;
   (b) coating said lubricated metal with an aqueous primer system comprising an organic titanium chelate dissolved in or admixed with water or a water-solvent mixture.

6. The method of claim 5 wherein the substrate is tinplate.

7. The method of claim 6 wherein the primer is applied from an aqueous spray comprising a titanium chelate selected from the group consisting of titanium acetyl acetonate, lactic acid titanium chelate and triethanolamine titanium chelate.

8. The method of claim 7 wherein said lubricant is acetyl tributyl citrate or dioctyl sebacate.

9. A method for priming metal substrates including the steps of:
   (a) applying acetyltributyl citrate or dioctyl sebacate to said metal surface;
   (b) coating said lubricated metal with an aqueous spray containing about 0.1% to 5% titanium acetyl acetonate and about 0.5% to 3% acetic acid dissolved in water or a water-isopropanol blend; and
   (c) drying the coating to produce a titanate film on said lubricated metal surface.

10. The method of claim 9 wherein the metal is tinplate.

11. A method for priming metal substrates including the steps of:
   (a) coating the metal surface with an aqueous spray containing about 0.1% to 5% titanium acetyl acetonate and 0.5% to 3% acetic acid dissolved in water or a water-isopropanol blend;
   (b) drying the coating to produce a titanate film on the metal surface; and
   (c) applying a acetyltributyl citrate or dioctyl sebacate lubricant over said titanate coated surface.

12. The method of claim 11 wherein said metal is tinplate.

* * * * *